US005472529A

United States Patent [19]

Arita et al.

[11] Patent Number: 5,472,529

[45] Date of Patent: Dec. 5, 1995

[54] EXPLOSIVE COMPOSITION AND METHOD FOR PRODUCING THE SAME

[75] Inventors: Takenori Arita; Shunichi Sato, both of Nobeoka, Japan

[73] Assignee: Asahi Kasei Kogyo Kabushiki Kaisha, Osaka, Japan

[21] Appl. No.: 185,811

[22] PCT Filed: Jun. 15, 1993

[86] PCT No.: PCT/JP93/00802

§ 371 Date: Feb. 14, 1994

§ 102(e) Date: Feb. 14, 1994

[87] PCT Pub. No.: WO93/25500

PCT Pub. Date: Dec. 23, 1993

[30] Foreign Application Priority Data

Jun. 26, 1991 [JP] Japan ..... 3-154321
Jun. 15, 1992 [JP] Japan ..... 4-178940

[51] Int. Cl.[6] ..... C06B 45/00

[52] U.S. Cl. ..... 149/2; 149/46; 149/109.6

[58] Field of Search ..... 149/2, 109.6, 46

[56] References Cited

U.S. PATENT DOCUMENTS

| | | | |
|---|---|---|---|
| 3,773,573 | 11/1973 | Slykhouse | 149/2 |
| 3,996,078 | 12/1976 | Klunsch et al. | 149/2 |
| 4,207,126 | 6/1980 | Ekman | 149/2 |
| 4,343,663 | 8/1982 | Breza et al. | 149/2 |
| 4,547,234 | 10/1985 | Takeuchi et al. | 149/3 |

FOREIGN PATENT DOCUMENTS

| | | |
|---|---|---|
| 0142271 | 5/1985 | European Pat. Off. . |
| 1544937 | 9/1968 | France . |
| 54-92614 | 7/1979 | Japan . |
| 57-47792 | 3/1982 | Japan . |
| 59-78994 | 5/1984 | Japan . |
| 61-36189 | 2/1986 | Japan . |
| 4-198081 | 7/1992 | Japan . |
| 1314285 | 4/1973 | United Kingdom . |
| 1344148 | 1/1974 | United Kingdom . |
| 2010239 | 6/1979 | United Kingdom . |

*Primary Examiner*—Donald P. Walsh
*Assistant Examiner*—Anthony R. Chi
*Attorney, Agent, or Firm*—Finnegan, Henderson, Farabow, Garrett & Dunner

[57] ABSTRACT

An explosive composition in which the explosive reactive component is adsorbed and held on the surfaces of and between the organic hollow microspheres, and a method of producing the same.

28 Claims, 2 Drawing Sheets

EXPLOSIVE COMPOSITION AND METHOD FOR PRODUCING THE SAME

TECHNICAL FIELD

The present invention relates to an explosive for industrial use. More particularly, it relates to an explosive composition that can be used for various destructive works such as blasting, crushing, excavation, etc., in the field of civil engineering and construction, mining operations such as quarrying, coal and other ore mining, etc., and operations in agricultural and forestry industries including drainage, irrigation, grubbing and lumbering.

BACKGROUND ART

Slurry explosives and emulsion explosives are typical of the conventional hydrous explosives. In these explosives, the active explosive components comprising an oxidizer solution, an inflammable material and a sensitizer and the bubbles are held stably in high concentrations in a mass in the presence of a sizing agent, and these explosives are usually detonated by means of a detonator. In the slurry explosives, the aerated bubbles or chemical bubbles are usually allowed to exist in the explosive composition to let them play a role like a sensitizer, and guar gum is used as sizing agent to compose an aqueous gel. In the emulsion explosives, an oxidizer solution and an oil serving as an inflammable agent are combined to form a W/O type emulsion in the presence of a surfactant serving as a sizing agent. The bubbles in these explosives comprise glass or resinous microballoons, besides the aerated bubbles.

Use of hollow monocellular thermoplastic particles for the improvement of detonation or the adjustment of density of these explosives is mentioned in U.S. Pat. No. 3,773,573 and JP-A-54-92614 with reference to slurry explosives and in JP-A-56-100192 and JP-A-59-78994 with reference to emulsion explosives. In U.S. Pat. No. 3,773,573 is disclosed a technique for application of hollow monocellular thermoplastic particles to a wide variety of explosives including slurry explosives, according to which the explosive composition is heated to a temperature substantially equal to the foaming temperature of the thermoplastic particles in the presence of the unfoamed resin particles in the producing process of the explosive charge. However, since heating was usually unrequired in the manufacture of slurry explosives, resin foaming in the producing process had little practical significance. Further, even if foaming by heating in the producing process was necessary, as understood from the explanation in JP-A-54-92614, there has been no alternative but to employ a two-stage system in which, for the reason of safety, a sensitizer is mixed after foaming by heating at the stage not yet added with the sensitizer has been completed.

In these hydrous explosives, delicate adjustment of the explosive components and the gel or emulsion structure is necessary for maintaining the detonation performance without containing a highly sensitive agent like nitroglycerin in dynamite, and a high-level technique is required for such adjustment. Thus, in the manufacture of said hydrous explosives, since the explosive detonation was affected by the quality and behavior of the explosive components through the forming process of the structure, a great deal of time and labor have been required for the control of quality of the starting materials and/or the control of the explosive producing conditions. As a result, there would arise the serious problems such as frequent production of the explosives of poor quality, which are unable to endure storage, and excessive deterioration of detonation performance with time. Especially when the amount of the chemical foams or the foaming agent used for the adjustment of density of the explosive composition is increased, it not only becomes harder to obtain the intended initial performance of the explosive but also the problem of deterioration of detonation performance with time becomes even more serious.

Further, the slurry explosives have their peculiar gel elasticity and lack plasticity, and when they are packed into a cartridge, such a cartridge itself proves to be soft and limp, so that it is hard to handle and also difficulties are encountered in inserting the cartridge into a blast hole, resulting in a reduced working efficiency for blasting operation. Also, because of poor moldability of this type of explosives, it was hard to use the explosives in the bare form without cartridge.

In the case of emulsion explosives, when they are given a sudden pressure, the emulsion structure could be destroyed to lose their detonating function (this phenomenon is called dead pressing phenomenon), and in short-delay blasting which is a normal form of blasting operation, there would be left an unexploded residue, posing a difficult problem for disposal thereof.

DESCRIPTION OF THE INVENTION

An object of the present invention is to provide an explosive composition which is basically composed of an oxidizer, water and organic hollow microspheres and which has a highly stabilized bursting performance and long-time keeping quality without a gel or emulsion structure such as seen in the conventional hydrous explosives.

Another object of the present invention is to provide an explosive composition which can be handled with safety, produces few unexplosed residue after blasting and is also capable of reducing the degree of harmfulness of the produced gases.

Still another object of the present invention is to provide a low-detonation-rate explosive having a stabilized blasting performance even in the low-density section, which has been difficult to obtain with the conventional explosives.

The ardent researches by the present inventors for overcoming the above problems of the conventional hydrous explosives have led to the attainment of the present invention.

Thus, the present invention provides a novel explosive composition characterized in that a liquid phase mainly composed of an oxidizer and water and containing substantially no viscous component is adsorbed and held on the surfaces of and/or between the organic hollow microspheres which are an inflammable component.

BEST MODE FOR CARRYING OUT THE INVENTION

Figure 1:
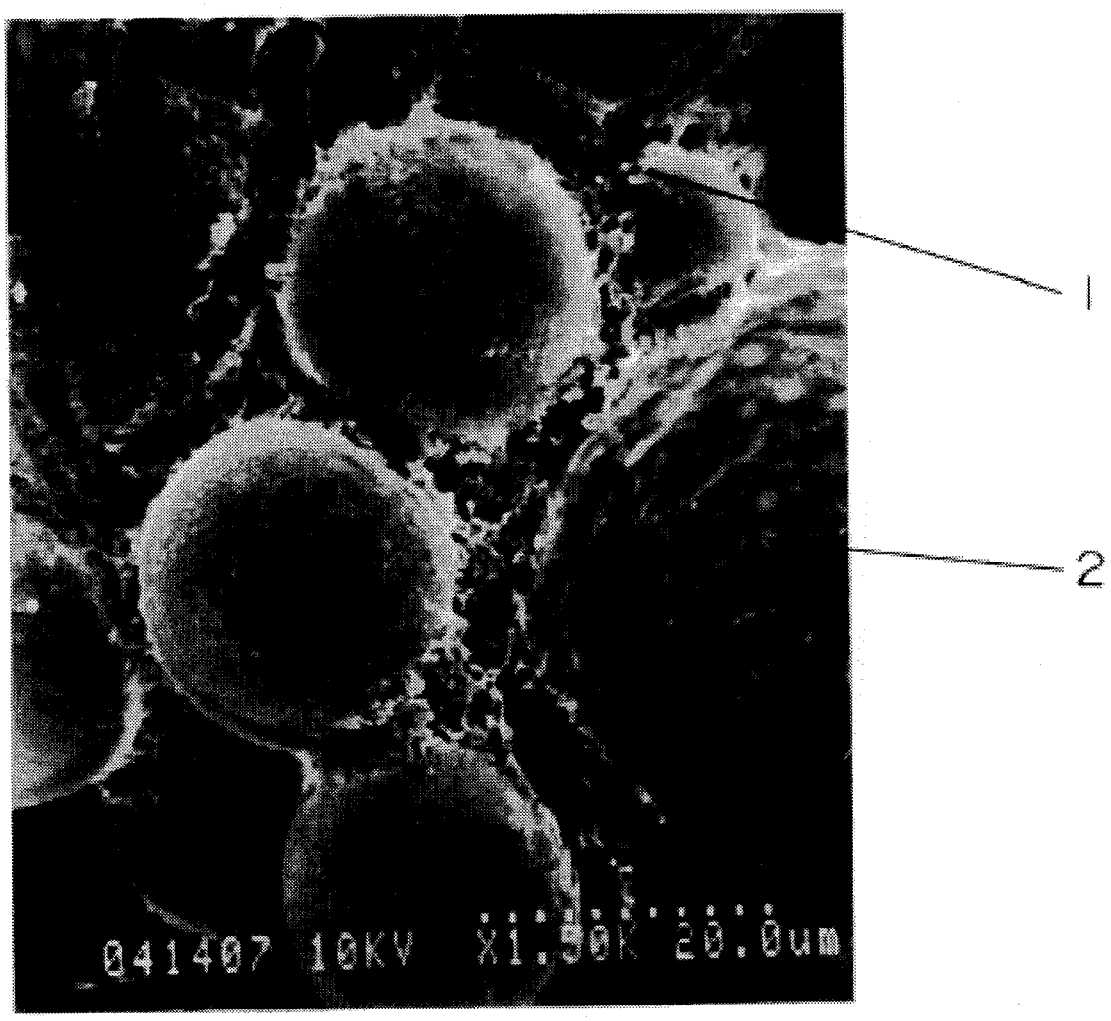
FIG. 1 is a microphotograph showing a fragmental fine structure of the explosive composition according to the present invention.
Figure 2A:
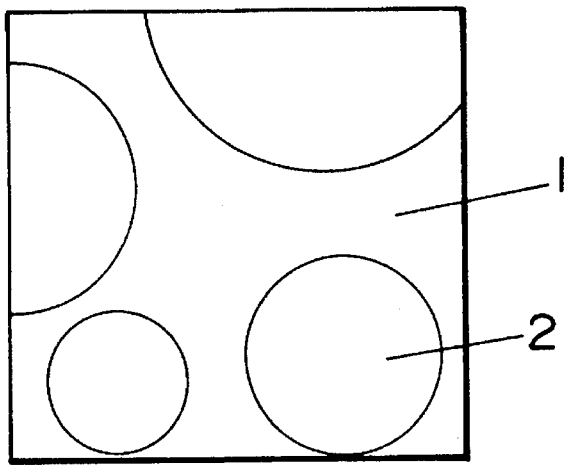
FIG. 2(*a*) is a schematic illustration of the above structure, and 2(*b*) and 2(*c*) are schematic illustrations of the conventional powder compositions.
Figure 2B:
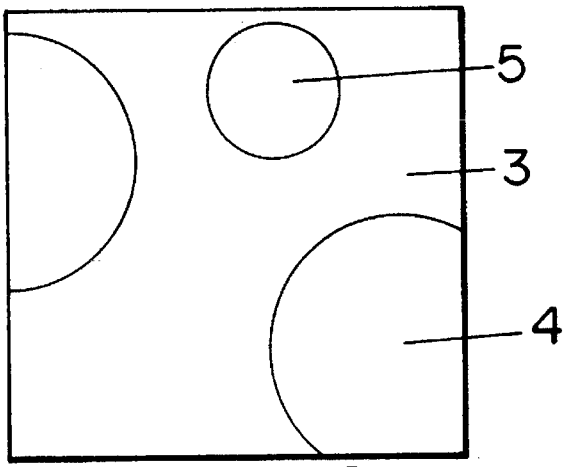
Figure 2C:
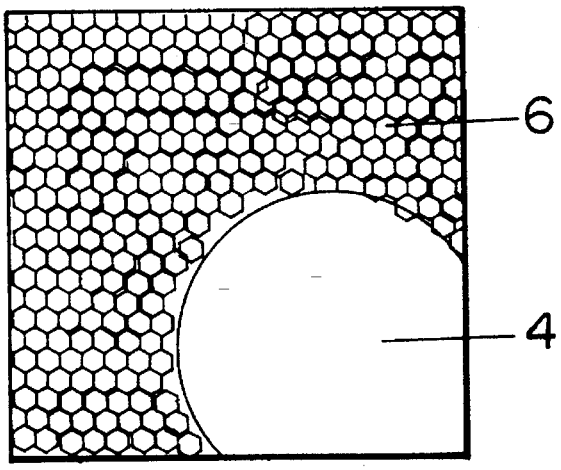

The fine structure of the explosive composition according to the present invention can be confirmed from, for example, microphotographs. As seen from FIG. 1 which is a typical microphotographical representation of the structure of the present explosive composition, the composition is an aggregation of small granular bodies each comprising an organic hollow microsphere 2 having a high-concentration oxidizer solution 1 adhering to its periphery. A conceptual illustration of this structure is given in FIG. 2(*a*), from which it is seen that in the explosive composition of this invention the organic hollow microspheres 2 constitute the structural core of the composition. This is a contrast to the compositional structure of the conventional slurry explosives in which, as shown in FIG. 2(*b*), the aerated bubbles 5 and hollow bodies 4 are dispersed in a gelled oxidizer/sensitizer phase 3. In the emulsion explosives, as shown in FIG. 2(*c*), the hollow bodies 4 such as glass microballoons are dispersed in an emulsified oxidizer solution phase 6. It is thus obvious that the explosive composition of the present invention is quite different from those of the conventional slurry and emulsion explosives in form of bubbles, form of the oxidizer solution and structure of the composition. More specifically, the composition of this invention requires no gelling agent needed in the conventional slurry explosives and has a structure in which, unlike the conventional slurry explosives, the bubbles are incorporated in a stable form in the organic hollow microspheres which are an inflammable component. Also, as compared with the emulsion explosives, the composition of this invention requires no oil phase as an inflammable component, no surfactant for forming an emulsion and no glass microballoons for holding the bubbles, which presents a striking contrast to the conventional emulsion explosives.

It has been known to use the hollow monocellular thermoplastic particles in the conventional slurry explosives, but the amount of such foams has been practically limited to about 2% at most in view of storage stability and blasting performance of the explosive composition. In the present invention, it was found quite surprisingly that by increasing the ratio of the organic hollow microspheres in a composition substantially consisting of an oxidizer solution and said microspheres, it is possible to obtain an explosive composition having a stable detonation performance even if no gelling agent, wax or surfactant is used. Further, since said hollow microspheres can concurrently serve as an inflammable component, it has become possible to provide an explosive with excellent performance without necessarily requiring use of an inflammable agent such as carbon or aluminum powder and a sensitizer mainly composed of an organic nitrate and/or an inorganic nitrate.

It is quite remarkable that in the explosive composition of the present invention, there takes place no separation of the liquid phase constituting principally the oxidizer component nor visually noticeable crystal separation of the oxidizer, and a stable structure can be maintained, so that the composition of this invention can be applied to a variety of explosives ranging from detonator explosives to booster explosives. Especially when the average thickness of the explosive compound layer around the organic hollow microsphere becomes about 20 μm or less as observed by a microscope, it is noted that the composition is even more stabilized.

The oxidizer used in the present invention can be selected from those known in the art. Examples of such oxidizers include ammonium salts, alkali metal salts and alkaline earth metal salts of inorganic acids such as nitric acid, chloric acid, perchloric acid and the like, and these oxidizers can be used either singly or in combination. Among these oxidizers, ammonium nitrate is especially recommendable as it has high solubility in water and is also easily available. The content of the oxidizer in the composition of the present invention is decided according to the specifications of the explosive to be produced, but usually it is in the range of 50 to 90% by weight based on the whole composition. When this oxidizer content is below the above-defined range, the quantity balance between oxygen and inflammable component is tipped to the minus side for oxygen, resulting in an increased toxicity of the gases released after blasting. On the other hand, when said content exceeds the above range, the blasting reactivity lowers to impair detonation propagation.

The water content in the composition of this invention is usually in the range of 3 to 20% by weight based on the whole composition. When the water content is below this range, the solid content of the explosive composition increases to affect the stable blasting performance thereof, while a too high water content results in a reduced detonating performance.

The organic hollow microspheres used in the present invention are preferably those made by using an organic high-molecular weight compound as base material. Examples of the organic high-molecular weight compounds usable here include phenol resins, epoxy resins, urea resins, unsaturated polyester resins, polyimides, maleic acid resins, melamine resins, celluloses, vinyl chloride, vinylidene chloride, acrylonitrile, acrylic acids, acrylic acid salts, acrylic esters, methacrylic acids, methacrylic acid salts, methacrylic esters, single polymers or copolymers of styrene, ethylene, propylene, butadiene, vinyl acetate and the like, polycarbonates, polysulfone, polyacetal, polyamides, polyethylene oxide, polyphenylene oxide and the like. These compounds may be used either singly or in combination. Among these organic high-molecular weight compounds, those having thermoplasticity, such as vinylidene chloride-acrylonitrile copolymer, vinylidene chloride-acrylonitrile-methacrylic ester copolymer, acrylonitrile-acrylic ester copolymer and the like are especially preferred for use in carrying out the process of the present invention. It is to be noted that the unfoamed microparticles of a vinylidene chloride-acrylonitrile copolymer or methyl methacrylate-acrylonitrile copolymer incorporated with a low-boiling point hydrocarbon can be easily made into hollow microspheres by heating, so that they can be used in a heat-foamed form after mixed with the explosive composition.

The organic hollow microspheres used in the composition of the present invention are not specifically defined; they may be hollow spheres containing a gas or air in the inside hollow portion or hollow bodies having closed or open spaces therein, but hollow spherical bodies are preferred for efficiently forming the hot spots where the explosive charge is detonated. The gas held in the organic hollow spheres may be air, a low-boiling point hydrocarbon, other inflammable gas, or a mixture thereof. The recommendable particle size of the organic hollow microspheres is about 1,000 μm or less in diameter. When the particle size exceeds this limit, the hot spots for initiating explosion are reduced in number, making it difficult to produce good detonation property. More preferably the organic hollow microspheres have a particle diameter of 20 to 200 μm as these spheres can provide a stabilized explosion without lowering the velocity of detonation. The film thickness of the organic hollow microspheres is not critical; it may be properly selected as far as the film has enough strength to give a space for accommodating the explosive composition. Usually, the film thickness is 0.1 to 5 μm. In case the organic high-molecular weight compound forming the organic hollow microspheres is the thermoplastic type, there are used those microspheres whose film thickness in the foamed state is about 0.1 to 2 μm since they are required to be capable of being foamed by heating in the explosive composition. The organic hollow microspheres in the explosive composition of this invention are usually of a bulk density of about 0.01 to 0.3 as measured in a dry state. The amount of the organic hollow microspheres in the composition is usually about 2 to 15% by weight based on the whole composition. The density of the explosive composition can be controlled by the amount of the organic hollow microspheres. Generally, when the ratio of the organic hollow microspheres in the composition is too low, the detonating efficiency is lowered, and it also becomes difficult to maintain a stabilized blasting performance for a long time. On the other hand, when the ratio of said organic hollow microspheres is too high, the power of explosion is lowered to jeopardize the blasting reliability.

According to the present invention, it is possible to obtain an explosive composition having a density ranging from 0.2 to 1.4 g/cm$^3$ in a stabilized way be adjusting the extent of foaming of the organic hollow microspheres. The explosive composition of this invention has a velocity of detonation of usually about 1,500 to 5,500 m/sec.

In a process for preparing the explosive composition of this invention, a mixture of an oxidizer and water is heated to a degree that will cause substantial dissolution of the mixture, and then the organic hollow microspheres are uniformly mixed therein.

The method for heat-foaming the organic microspheres is not specified in this invention, but the following methods may be cited as recommendable examples: ① an oxidizer, water and the foamable organic microspheres are heated to a temperature that allows substantially uniform mixing of said materials to form a mixed solution, and then this solution is dropped or sprayed onto a heated plate or into an atmosphere adjusted to a temperature, or above that, at which said microspheres are caused to begin foaming, thereby foaming the organic microspheres contained in said mixed solution; ② an oxidizer, water and the foamable organic microspheres are heated to a temperature allowing substantially uniform mixing of said materials to form a mixed solution, and the solution is supplied into a metal tube heated to a temperature, or above that, which causes start of foaming of said microspheres, thereby foaming the organic microspheres contained in said mixed solution; ③ a mixed solution of an oxidizer, water and the foamable organic microspheres is put into a container and this container is heated in an external bath of a temperature at which foaming of said microspheres takes place, thereby foaming the organic microspheres contained in said mixed solution; ④ an oxidizer, water and the foamable organic microspheres are uniformly mixed and heated to a temperature that allows substantially uniform mixing of said materials to form a mixed solution, then an amount of this solution determined by taking into consideration the volume expansion thereof (on heating) was filled in a heat-resistant film tube, and after deairing and hermetically closing said film tube, it was placed in a hot bath or oil bath heated to a temperature, or above that, at which foaming of said microspheres begins, thereby foaming the organic microspheres contained in said mixed solution; ⑤ a mixture of an oxidizer and water is heated to cause dissolution of the best part of the solid salts to form a high-concentration salt solution, then this solution is heated to a temperature, or above that, at which foaming of the foamable organic microspheres takes place, and said organic microspheres are mixed in said solution. In these methods, in case it is expected that water will be evaporated from the composition, the amount of water that may be evaporated is estimated and water is added in an excess amount so that the desired explosive composition will be provided. Also, according to the process for producing the explosive composition of this invention, it is possible to optionally change the foaming condition by adjusting the temperature, and there can be obtained a variety of explosives ranging from the type detonated by a booster to the type that can be detonated by a single percussion. The unfoamed organic microspheres are increased in internal pressure by heating and begin to foam as they are heated close to a temperature at which the organic polymer film begins to soften, and they are expanded about 20- to 100-fold in volume ratio. However, if the organic hollow microspheres are heated more than necessary and bursted, they can no longer serve as an effective component of an explosive, so that it is recommended to stop heating before reaching a temperature at which overfoaming may be caused.

The explosive composition according to the present invention can be presented in various forms such as solid, powder, flakes, paste, etc., and it can be packed with a known packaging material such as paper, laminated paper, plastic film, laminated plastic film, paper tube, plastic tube, etc., selected according to the form of the composition, its properties, object of use and other factors, and thus can be commercially offered in the form of packs.

The explosive composition of this invention is capable of well satisfying the quality requirements for an explosive, but for additional improvement of blasting performance, an organic nitrate such as a lower saturated aliphatic amine or an inorganic nitrate such as hydrazine nitrate may be added as a sensitizer to accommodate use in the cold districts. Also, in consideration of gas release after blasting in a tunnel or underground mine, a solid inflammable material such as coal powder or aluminum powder may be additionally supplied. Other pertinent substances, for example, an activator such as phosphoric ester, a decomposition inhibitor such as urea, etc., may be safely added as desired.

With the explosive composition and its producing method according to the present invention, there can be obtained a variety of explosives ranging from the booster-blasted type to the percussion-initiated type, and the explosives with a wide variety of dead pressing density. The present invention can be applied to formulation of almost all sorts of conventional explosives. Also, the explosive composition of this invention is improved in dead pressing phenomenon attendant on the emulsion explosives, that is, improved in anti-dead pressing property, and the safety in the work field can be further improved due to the reduction of the unexploded compound residue. The production method according to this invention needs no high-degree production techniques such as required in the production of the conventional slurry and emulsion explosives, and is capable of producing a desired type of explosive with ease and safety.

The explosive composition of this invention can be usually detonated by using various known systems such as electric detonator, industrial detonator, detonator with blasting tube, detonator with gas-blasting tube, electromagnetic detonator, laser detonator, wireless detonator, blasting fuse, detonating fuse, etc. In some cases, the explosive composition may be detonated by using a booster.

EXAMPLES

The present invention will hereinafter be described in more detail with reference to the examples thereof, which examples, however, are merely intended to be illustrative and not to be construed as limiting the scope of the invention. The cap sensitivity, booster performance, velocity of detonation, cartridge propagation in steel tube and anti-dead pressing property in sand were determined by the following methods.

Determination of cap sensitivity

An explosive charge was densely packed in a polyethylene laminated paper tube or a nylon 66 film tube (pack diameter: 20 mm or 30 mm; pack length: about 200 mm) and kept in a refrigerator of about −30° C. for about 15 hours. Thereafter, the charge, with its temperature adjusted, was detonated by a #6 detonator, and the temperature at which the charge was perfectly exploded was measured. For evaluating the keeping quality, the same detonation test was conducted on the same explosive charge which has been kept in storage for one year after production thereof.

Determination of booster performance

A test explosive filled in a steel cylinder (JIS G 3452 32A; inner diameter: 36 mm; length: 350 mm) closed on one side in the longitudinal direction was detonated by a booster (50 g of #2 Enoki dynamite attached with a #6 detonator), and from visual observation of the state of wrecking of the steel cylinder, it was determined whether perfect explosion occurred or not. For evaluating the keeping quality, the same detonation test was conducted on the same explosive which has been kept in storage for one year after production thereof.

Determination of velocity of detonation of packed explosive

An explosive charge packed in a polyethylene laminated paper tube or a nylon 66 film tube (pack diameter: 20 mm or 30 mm; pack length: 300 mm) was detonated by a #6 detonator, and the velocity of detonation was determined by the ion gap method. For evaluating the keeping quality, the same detonation test was conducted on the same explosive which has been kept in storage for one year after production thereof.

Determination of velocity of detonation of explosive packed steel tube

An explosive packed in a steel tube (JIS G 3452 32A; inner diameter: about 36 mmϕ; length: 350 mm) was detonated by a booster (50 g of #2 Enoki dynamite attached with a #6 detonator), and the velocity of detonation was determined by the ion gas method. For evaluating the keeping quality the same detonation test was conducted on the same explosive which has been kept in storage for one year after production thereof.

Propagation test by cartridge in steel tube

An explosive charge was packed in a polyethylene laminated paper tube or a nylon 66 film tube (pack diameter: about 20 mmϕ; pack length: 150 mm), and about 20 packs were set in juxtaposition to each other in a steel tube (JIS G 3452 40A; inner diameter: about 41.6 mm; length: 3,000 mm) so that no deformation would take place in the longitudinal direction. Then the pack at an end was detonated by #6 detonator and the length of the wrecked portion of the steel tube was measured to determine propagation performance in steel tube. For evaluating the keeping quality, the same test was conducted on the same packs which have been kept in storage for one year after production thereof.

Determination of anti-dead pressing in sand

An explosive charge was packed in a polyethylene laminated paper tube or a nylon 66 film tube (pack diameter: 30 mm; pack length: about 150 mm). There were prepared 2 packs, and they were arranged side by side and buried 80 cm deep in sand, with an instantaneous #6 electric detonator attached to one pack while a 10 ms short-delay electric detonator attached to the other pack. Both electric detonators were connected in series and electrified for detonating the explosive. This test was conducted 5 times repeatedly, and it was checked whether the explosive pack attached with the 10 ms short-delay electric detonator was perfectly detonated or not to determine anti-dead pressing property in sand. For evaluating the keeping quality, the same test was conducted on the same packs which have been kept in storage for one year after production thereof.

Example 1

805 g of ammonium nitrate and 135 g of water were mixed and heated to about 90° C. Meanwhile, 60 g of organic hollow microspheres (EXPANCEL® 551DE (a vinylidene chloride-acrylonitrile-methacrylic ester copolymer) produced by Expancel AB) was weighed out and put into a polyethylene bag. Then the above mixture was charged into the polyethylene bag. Thereafter, the opening of the bag was closed and the materials in the bag were mixed with stirring for about 10 minutes by applying a force to the bag sidewise thereof and then cooled with water to obtain an explosive composition with an explosive density of 0.40 g/cm$^3$. This explosive composition was packed in a steel tube (JIS G 3452 32A; inner diameter: about 36 mm; length: 350 mm) which had been closed on one side in the longitudinal direction, and detonated by a booster (50 g of #2 Enoki dynamite attached with a #6 detonator). There took place perfect detonation. When the same test was conducted with the same explosive composition kept in storage for one year after production thereof, the similar results were obtained.

Example 2

1608 g of ammonium nitrate, 310 g of water and 82 g of non-foamed organic microspheres (MATSUMOTO MICROSPHERE F-30 which is a vinylidene chloride-acrylonitrile-methacrylic ester copolymer produced by Matsumoto Yushi-Seiyaku Co., Ltd.) were supplied into a metallic container and mixed with stirring in an external bath of about 80° C. to obtain a mixture of about 70° C. There was also prepared a metal plate heated to about 100°–150° C. The above mixture was dropped peacemeal onto the surface of said metal plate, whereby a granular explosive composition could be obtained in a very short time.

This explosive composition was dispensed and packed in the polyethylene laminated paper tubes of 20 mm and 30 mm in diameter to obtain the explosive packs each containing 30–40 g of said composition, and their blasting performance was examined. The density of the 30 mm-diameter pack was 0.35 g/cm$^3$, and this pack could be detonated by a #6 detonator at −10° C. The rate of detonation at the temperature of 5° C. was 1,900 m/s. The 2 mm-diameter pack was loaded in a steel tube having an inner diameter of 41.6 mm and a length of 3 m and detonated from one end thereof by a #6 detonator. As a result, all of the explosive charge was perfectly detonated, and the length of the wrecked portion of the steel tube was 3 m. Further, two pieces of said 30 mm-diameter explosive pack were subjected to an in-sand dead pressing test in which the two packs were buried in sand parallel to each other with a spacing of 15 cm therebetween, with an instantaneous #6 detonator attached to one pack and a 10 ms short-delay electric detonator attached to the other pack, and detonated by electrifying said detonators. This test was conducted 5 times, and both packs were perfectly detonated in each run of test. When the same test was conducted using the same packs which have been kept in storage for one year after production thereof, the similar result was obtained. On the other hand, when the same test was carried out using the conventional slurry and emulsion explosives prepared by an ordinary method, with the charge density properly adjusted, any of the packs could not be detonated by a #6 detonator a temperature below 0° C. Also, in an explosive charge propagation test in a steel tube, detonation was interrupted at a point close to 1.2 m from the detonated end, and the length of the wrecked portion of the steel tube was about 0.8–1.6 m. Further, in an in-sand dead pressing test, two of the explosive packs attached with a 10 ms short-delay electric detonator were not perfectly detonated and recovered as incompletely exploded packs. When the same test was conducted with the same packs kept in storage for one year after production thereof, it was found that any of them was deteriorated in performance quality to an extent that they could not be detonated by a #6 detonator.

Examples 3–5

The following explosive compositions were produced in the same way as Example 1, and their blasting performance was examined.

| | Example 3 | Example 4 | Example 5 |
|---|---|---|---|
| Ammonium nitrate | 1530 g | 1550 g | 1530 g |
| Water | 270 g | 270 g | 270 g |
| Non-foamed organic microspheres 1 | 200 g | — | — |
| Non-foamed organic microspheres 2 | — | 180 g | — |
| Non-foamed organic microspheres 3 | — | — | 200 g |

The non-foamed organic microspheres 1 were the same as used in Example 2. The non-foamed organic microspheres 2 were made of an acrylonitrile-methyl methacrylate copolymer (053WU produced by Expancel AB), and the non-foamed organic microspheres 3 were composed of an acrylonitrile-acrylic ester copolymer (MATSUMOTO MICROSPHERE F-30, Matsumoto Yusi-Seiyaku Co., Ltd.).

The 20 mm-diameter and 30 mm-diameter pack densities of the above three explosive compositions were 0.23, 0.30 and 0.40, respectively. The 30 mm-diameter packs at a temperature of −10° C. could be detonated by a #6 detonator. The velocity of detonation of said three explosive compositions at a temperature of 5° C. was 1,900 m/s, 2,000 m/s and 2,200 m/s, respectively. When a 20 mm-diameter pack was loaded in a steel tube of 41.6 mm in inner diameter and 3 m in length and detonated from one end thereof, all of the explosive charge was perfectly detonated and the length of the wrecked portion of the steel tube was 3 m. When the same test was conducted using the same explosive compositions left one year after production thereof, the similar results were obtained. On the other hand, when the same test was conducted using the conventional slurry and emulsion explosives prepared by an ordinary process, with the explosive charge density being properly adjusted, any of the explosive packs could not be detonated at a temperature below 0° C. Also, in an explosive pack propagation test in a steel tube, detonation was interrupted at a point close to 0.8–1.6 m from the detonated end, and the length of the wrecked portion of the steel tube was about 0.8–1.6 m. The same test was further carried out using the same explosive compositions kept in storage for one year after production thereof, but any of the compositions has been deteriorated in performance quality to the extent that it could not be detonated by a #6 detonator.

Example 6

1608 g of ammonium nitrate, 310 g of water and 82 g of non-foamed organic microspheres (MATSUMOTO MICROSPHERE F-30 which is a vinylidene chloride-acrylonitrile-methacrylic ester copolymer, produced by Matsumoto Yusi-Seiyaku Co., Ltd.) were charged into a metallic container and mixed with stirring in a water bath of about 70° C. to obtain a mixture of about 70° C. This mixture was injected into a 20 mm-diameter metallic tube (Teflon coated on the inner wall), which had been heated to about 100°–150° C., from one end thereof, and an open-cell foamed string-shaped explosive composition was obtained from the other end.

The thus obtained explosive composition was dispended to form the explosive packs in the manner described above, and their blasting performance was examined. The density of the 20 mmϕ packs was 0.45 g/cm$^3$, and these packs could be detonated by a #6 detonator at a temperature of −5° C. The velocity of detonation at the temperature of 5° C. was 1,900 m/s. When an explosive pack, cut to a length of 3 m, was loaded in a steel tube of 41.6 mm in diameter and 3 m in length and detonated from one end thereof by a #6 detonator, all of the explosive charge was perfectly detonated and the length of the wrecked portion of the steel tube was 3 m. Further, two pieces of said 30 mmϕ explosive pack were subjected to an in-sand dead pressing test in which the two packs were buried 80 cm deep in sand parallel to each other with a spacing of 15 cm therebetween, with an instantaneous #6 detonator attached to one of said packs and a 10 ms short-delay electric detonator attached to the other pack, and both detonators were electrified simultaneously to cause detonation. This test was conducted 5 times. Both packs were perfectly detonated in each run of test. When the same test was carried out using the same explosive composition which had been kept in storage for one year after production thereof, the similar result was obtained.

Example 7

1,524 g of ammonium nitrate, 286 g of water and 190 g of non-foamed organic microspheres (MATSUMOTO MICROSPHERE F-30, a vinylidene chloride-acrylonitrile-methacrylic ester copolymer produced by Matsumoto Yusi-Seiyaku Co., Ltd.) were put into a metallic container and mixed with stirring in an external bath of about 90° C. to obtain a mixture of about 70°–80° C. This mixture was injected into a 20 mmϕ metal tube (Teflon coated on inner wall), which had been heated to about 90°–110° C., from the opening at one end thereof, and a creamy explosive composition having a density of 1.35 g/cm$^3$ was obtained from the opening at the other end.

When the above explosive composition was packed in a steel tube (JIS G 3452 32A; inner diameter: 36 mm; length: 350 mm), which had been closed on one side in the longitudinal direction, and detonated by a booster (50 g of #2 Enoki dynamite attached with a #6 detonator), said composition was perfectly detonated, and the velocity of detonation was 5,460 m/s. When the same test was conducted using the same explosive composition kept in storage for one year after production thereof, the similar result was obtained.

Examples 8–10

The following explosive compositions were produced by following the procedure of Example 7, and their blasting performance was examined.

| | Example 8 | Example 9 | Example 10 |
|---|---|---|---|
| Ammonium nitrate | 1560 g | 1524 g | 1530 g |
| Water | 320 g | 286 g | 270 g |
| Non-foamed organic microspheres 1 | 120 g | — | — |
| Non-foamed organic microspheres 2 | — | 190 g | — |
| Non-foamed organic microspheres 3 | — | — | 200 g |

The non-foamed organic microspheres 1 were the same as used in Example 1, and the non-foamed organic microspheres 2 were made of an acrylonitrile-methyl methacrylate copolymer (053WU, Expancel AB). The non-foamed organic microspheres 3 were composed of an acrylonitrile-acrylic ester copolymer (MATSUMOTO MICROSPHERE F-50, Matsumoto Yusi-Seiyaku Co., Ltd.).

The densities of the above three explosive compositions were 1.38 g/cm$^3$ and 1.35 g/cm$^3$, respectively. Each of the above explosive compositions was packed in a steel tube (JIS G 3452 32A; inner diameter: about 36 mm; length: 350 mm), which had been closed on one side in the longitudinal direction, and detonated by a booster (50 g of #2 Enoki dynamite attached with a #6 detonator). As a result, each of said explosive compositions was detonated perfectly, and the velocity of detonation was 5,500 m/s, 4,600 m/s and 5,100 m/s, respectively. When the same test was conducted on the same explosive compositions which had been kept in storage for one year after production thereof, the similar result was obtained.

Example 11

1608 g of ammonium nitrate, 310 g of water and 82 g of non-foamed organic microspheres (MATSUMOTO MICROSPHERE F-30, a vinylidene-acrylonitrile-methacrylic ester copolymer, produced by Matsumoto Yusi-Seiyaku Co., Ltd.) were placed in a stainless steel container and heated with slow stirring in an oil bath of about 100°–130° C. to obtain a creamy explosive composition. This explosive composition was dispensed and packed in the 20 mmϕ and 30 mmϕ polyethylene laminated paper tubes to form the explosive packs each containing about 50 g of said composition, and their blasting performance was examined. The density of the 30 mmϕ explosive pack was 0.70 g/cm$^3$, and this pack could be detonated by a #6 detonator at −5° C. The velocity of detonation at of 5° C. was 2,500 m/s. The 20 mmϕ pack was loaded in a steel tube of 41.6 mm in inner diameter and 3 m in length and detonated from one end by a #6 detonator. All of the explosive charge was perfectly detonated, and the length of the wrecked portion of the steel tube was 3 m. Further, two 30 mmϕ explosive packs were subjected to an in-sand dead pressing test in which said two packs were buried 80 cm deep in sand parallel to each other with a spacing of 15 cm therebetween, with a #6 electric detonator attached to one pack and a 10 ms short-delay detonator attached to the other pack, and detonated by electrifying said detonators. This test was conducted 5 times. Both packs were perfectly detonated in each run of test. When the same test was conducted on the same explosive composition kept in storage for one year after production thereof, the similar result was obtained.

Example 12

1,250 g of ammonium nitrate, 170 g of water and 160 g of sodium nitrate, 300 g of monomethylamine nitrate and 120 g of non-foamed organic microspheres (MATSUMOTO MICROSPHERE F-30, a vinylidene chloride-acrylonitrile-methacrylic acid copolymer) were mixed while heating to about 70° C. to form a homogeneous mixed solution. An amount of this solution, determined by taking into consideration possible volume expansion on heating, was filled in a 20 mmϕ nylon 66 film tube. After deairing this tube and then closing both ends thereof, said tube was placed in a hot bath of 100°–150° C. to heat the mixed solution therein, causing foaming of the organic microspheres contained in said mixture, and the blasting performance as an explosive composition packed in said nylon 66 film tube was examined. The density of the explosive charge in said 20 mmϕ nylon 66 film tube was 0.35 g/cm$^3$, and this explosive pack could be detonated by a #6 detonator at −10° C. The velocity of detonation at 5° C. was 2,200 m/s. Also, the above explosive pack was loaded in a steel tube of 41.6 mm in diameter and 3 m long and detonated from one end thereof by a #6 detonator. As a result, all of the explosive charge was perfectly detonated, and the length of the wrecked portion of the steel tube was 3 m. When the same test was conducted using the same explosive composition which had been kept in storage for one year after production thereof, the similar result was obtained.

Example 13

1,050 g of ammonium nitrate, 170 g of water, 300 g of sodium nitrate and 360 g of monomethylamine nitrate were mixed and heated to about 70° C. to prepare a mixture. Meanwhile, 120 g of organic hollow microspheres (EXPANCEL® 551DE, a vinylidene chloride-acrylonitrile-methacrylic ester copolymer produced by Expancel AB) was weighed out and placed in a polyethylene bag. Then the above mixture was charged into said bag, and after closing its opening, the bag was subjected to a stirring force applied to the bag sidewise thereof for about 10 minutes to mix the materials in the bag, followed by cooling to obtain an explosive composition. This explosive composition was dispensed and packed in the 20 mmϕ and 30 mmϕ polyethylene laminated paper tubes to form the explosive packs each containing about 30–40 g of said composition, and their blasting performance was examined. The density of the 30 mmϕ explosive pack was 0.35 g/cm$^3$, and this pack could be detonated by a #6 detonator at of −20° C. The velocity of detonation at 5° C. was 2,300 m/s. The 20 mmϕ explosive pack was loaded in a steel tube of 41.6 mm in diameter and 3 m in length and detonated from one end thereof by a #6 detonator. As a result, all of the explosive charge was perfectly detonated, and the length of the wrecked portion of the steel tube was 3 m. Further, a pair of 30 mmϕ explosive packs were subjected to an in-sand dead pressing test in which both packs were buried 80 cm deep in sand parallel to each other with a spacing of 15 cm therebetween, with an instantaneous #6 detonator attached to one pack and a 10 ms short-delay electric detonator attached to the other pack, and detonated simultaneously by electrifying said detonators. This test was conducted 5 times, and both packs were perfectly detonated in each run of test. When the same test was carried out using the same explosive composition which had been kept in storage for one year after production thereof, the similar result was obtained.

Examples 14 and 15

The following explosive compositions were produced by following the procedure of Example 13, and their blasting performance was examined.

| | Example 14 | Example 15 |
|---|---|---|
| Ammonium nitrate | 1,520 g | 1,330 g |
| Water | 80 g | 170 g |
| Monomethylamine nitrate | 350 g | 300 g |
| Sodium nitrate | — | 160 g |
| Organic hollow microspheres | 50 g | 40 g |

The 30 mmϕ pack densities of the above two explosive compositions were 1.02 and 0.95, respectively, and the packed compositions could be detonated by a #6 detonator at 0° C. The velocity of detonation at 5° C. was 3,700 m/s and 3,200 m/s, respectively. When the same test was conducted on the same explosive compositions which had been kept in storage for one year after production thereof, the similar results were obtained.

Example 16

1,296 g of ammonium nitrate, 164 g of water, 358 g of monomethylamine nitrate and 78 g of non-foamed organic microspheres (MATSUMOTO MICROSPHERE F-30 which is a vinylidene chloride-acrylonitrile-methacrylic ester copolymer produced by Matsumoto Yusi-Seiyaku Co., Ltd.) were placed in a metallic container and mixed by stirring the container in a water bath of about 70° C. to obtain a mixture of about 70° C. Meanwhile, there was prepared a metal plate (Teflon coated on inner side) heated to about 100°–150° C. The above mixture was dropped peacemeal onto the surface of said hot metal plate, thereby obtaining a granular explosive composition in a very short time.

This explosive composition was dispended and packed in the 20 mmϕ and 30 mmϕ polyethylene laminated paper tubes to form the explosive packs each containing about 30–40 g of said composition, and their blasting performance was examined. The density of the 30 mmϕ explosive pack was 0.80 g/cm$^3$, and this pack could be detonated by a #6 detonator at −15° C. The velocity of detonation at 5° C. was 3,700 m/s. The 20 mmϕ explosive pack was loaded in a steel tube of 41.6 mm in inner diameter and 3 m in length and detonated from one end thereof by a #6 detonator. As a result, all of the explosive charge was perfectly detonated, and the length of the wrecked portion of the steel tube was 3 m. Further, a pair of 30 mmϕ explosive packs were subjected to an in-sand dead pressing test in which both packs were buried 80 cm deep in sand parallel to each other with a spacing of 15 cm therebetween, with an instantaneous #6 detonator attached to one pack and a 10 ms short-delay electric detonator attached to the other pack, and detonated simultaneously by electrifying said detonators. This test was repeated 5 times, and both packs were perfectly detonated in each run of test. When the same test was conducted on the same explosive compositions which had been kept in storage for one year after production thereof, the similar results were obtained.

Examples 17–19

The following explosive compositions were produced according to the process of Example 16 and their blasting performance was examined.

| | Example 17 | Example 18 | Example 19 |
|---|---|---|---|
| Ammonium nitrate | 1338 g | 1490 g | 1470 g |
| Water | 210 g | 170 g | 170 g |
| Monomethylamine nitrate | 300 g | 240 g | 240 g |
| Sodium nitrate | — | 140 g | — |
| Non-foamed organic microspheres 1 | 152 g | — | — |
| Non-foamed organic microspheres 2 | — | 100 g | — |
| Non-foamed organic microspheres 3 | — | — | 120 g |

The non-foamed organic microspheres 1 are the same as used in Example 16, and the non-foamed organic microspheres 2 are made of an acrylonitrile-methyl methacrylate copolymer (053WU, Expancel AB). The non-foamed organic microspheres 3 are composed of an acrylonitrile-acrylic ester copolymer (MATSUMOTO MICROSPHERE F-50, Matsumoto Yusi-Seiyaku Co., Ltd.).

The 20 mmϕ and 30 mmϕ pack densities of the above three explosive compositions were 0.20, 0.30 and 0.45, respectively. The 30 mmϕ pack at −25° C. could be detonated by a #6 detonator. The velocity of detonation at 5° C. was 1,900 m/s, 2,300 m/s and 2,500 m/s, respectively. The 20 mmϕ pack was loaded in a steel tube of 41.6 mm in diameter and 3 m in length and detonated from one side by a #6 detonator. The whole pack charged was detonated perfectly, and the length of the wrecked portion of the steel tube was 3 m. When the same test was carried out on the same explosive compositions which had been kept in storage for one year after production thereof, the similar results were obtained.

Example 20

1,346 g of ammonium nitrate, 240 g of water, 80 g of sodium nitrate, 174 g of monomethylamine nitrate and 160 g of non-foamed organic microspheres (MATSUMOTO MICROSPHERE F-30) were supplied into a stainless steel container and heated with slow stirring in an oil bath of about 80°–90° C. to obtain an explosive composition with an explosive density of 1.38 g/cm$^3$. When this explosive composition was charged into a steel tube (JIS G 3452 32A; inner diameter: 36 mm; length: 350 mm), which had been closed on one side in the longitudinal direction, and detonated by a booster (50 g of #2 Enoki dynamite attached with a #6 detonator), the above explosive composition was perfectly detonated. The velocity of detonation was 5,600 m/s. When the same test was conducted on the same explosive composition which had been kept in storage for one year after production thereof, the similar result was obtained.

INDUSTRIAL APPLICABILITY

The explosive composition according to the present invention, in virtue of its peculiar structure in which the active component comprising an oxidizer and water or a sensitizer, an oxidizer and water is held continuously on the surfaces of and/or in the spaces between the adjoining microspheres, substantially unnecessitates use of a thickener which has been indispensable for maintenance of quality of the conventional hydrous explosive compositions, and it can not only keep its quality for a long time but also realized practical use of the low-specific-gravity products which has been considered unfeasible with the conventional hydrous explosives. Owing to reduction of specific gravity, the noise and vibration generated at the time of blasting can be remarkably lessened.

We claim:

1. An explosive composition comprising an oxidizer, water and organic hollow microspheres, wherein a phase substantially composed of said oxidizer and water is adsorbed and held on the surfaces of and/or between said organic hollow microspheres.

2. An explosive composition according to claim 1, wherein the organic hollow microspheres are substantially spherical.

3. An explosive composition according to claim 1 or 2, wherein the organic hollow microspheres are thermoplastic.

4. An explosive composition according to claim 1 or 2, wherein the thermoplastic organic hollow microspheres are made of a vinylidene chloride-acrylonitrile copolymer.

5. An explosive composition according to claim 1 or 2, wherein the thermoplastic organic hollow microspheres are made of a vinylidene chloride-acrylonitrile-methacrylic ester copolymer.

6. An explosive composition according to claim 1 or 2, wherein the thermoplastic organic hollow microspheres are made of an acrylonitrile-acrylic ester copolymer.

7. An explosive composition pack in which an explosive composition according to claim 1 or 2 is packed in a packaging material.

8. A method of producing an explosive composition substantially consisting of an oxidizer, water and organic hollow microspheres, said organic hollow microspheres being used as an inflammable component, which method comprises mixing 2–15% by weight of foamable organic microspheres, 3–20% by weight of water and the balance essentially consisting of an oxidizer to prepare a composition substantially free of aerated bubbles, and then heating and foaming said composition.

9. The method according to claim 8, wherein the foamable organic microspheres are substantially spherical.

10. The method according to claim 8 or 9, wherein the foamable organic microspheres are thermoplastic.

11. The method according to any of claims 8–10, wherein the thermoplastic foamable organic microspheres are made of a vinylidene chloride-acrylonitrile copolymer.

12. The method according to any of claims 8–10, wherein the thermoplastic foamable organic microspheres are made of a vinylidene chloride-acrylonitrile-methacrylic ester copolymer.

13. The method according to any of claims 8–10, wherein the thermoplastic foamable organic microspheres are made of an acrylonitrile-acrylic ester copolymer.

14. An explosive composition pack in which an explosive composition according to any of claims 8–13 is packed in a packaging material.

15. An explosive composition comprising an oxidizer, water and organic hollow microspheres, wherein a phase substantially composed of a sensitizer, an oxidizer and water is adsorbed and held on the surfaces of and/or between said organic hollow microspheres.

16. An explosive composition according to claim 15, wherein the organic hollow microspheres are substantially spherical.

17. An explosive composition according to claim 15 or 16, wherein the organic hollow microspheres are thermoplastic.

18. An explosive composition according to claim 15 or 16, wherein the thermoplastic organic hollow microspheres are made of a vinylidene chloride-acrylonitrile copolymer.

19. An explosive composition according to claim 15–16, wherein the thermoplastic organic hollow microspheres are made of a vinylidene chloride-acrylonitrile-methacrylic ester copolymer.

20. An explosive composition according to claim 15–16, wherein the thermoplastic organic hollow microspheres are made of an acrylonitrile-acrylic ester copolymer.

21. An explosive composition pack in which an explosive composition according to any of claims 15 or 16 is packed in a packaging material.

22. A method of producing an explosive composition substantially consisting of a sensitizer, an oxidizer, water and organic hollow microspheres, which comprises mixing 2–15% by weight of foamable organic microspheres, 3–20% by weight of water and the balance essentially consisting of a sensitizer and an oxidizer to prepare a composition substantially free of aerated bubbles, and heating and foaming said composition.

23. The method according to claim 22, wherein the foamable organic microspheres are substantially spherical.

24. The method according to claim 22 or 23, wherein the foamable organic microspheres are thermoplastic.

25. The method according to any of claims 22–24, wherein the thermoplastic organic microspheres are made of a vinylidene chloride-acrylonitrile copolymer.

26. The method according to any of claims 22–24, wherein the thermoplastic foamable organic microspheres are made of a vinylidene chloride-acrylonitrile-methacrylic ester copolymer.

27. The method according to any of claims 22–24, wherein the thermoplastic foamable organic microspheres are made of an acrylonitrile-acrylic ester copolymer.

28. An explosive composition pack in which an explosive composition produced according to any of the methods of claims 22–27 is packed in a packaging material.

* * * * *

UNITED STATES PATENT AND TRADEMARK OFFICE

CERTIFICATE OF CORRECTION

PATENT NO. : 5,472,529
DATED : December 5, 1995
INVENTOR(S) : Takenori Arita, et. al.

It is certified that error appears in the above-indentified patent and that said Letters Patent is hereby corrected as shown below:

Claim 19, col. 16, line 16, "15-16" should read --15 or 16--.
Claim 20, col. 16, line 20, "15-16" should read --15 or 16--.
Claim 21, col. 16, line 24, "any of claims 15 or 16" should read--claim 15 or 16--.

Signed and Sealed this

Twelfth Day of March, 1996

Bruce Lehman

*Attest:*

BRUCE LEHMAN

*Attesting Officer*

*Commissioner of Patents and Trademarks*